United States Patent [19]

Lindsey

[11] Patent Number: 4,769,959

[45] Date of Patent: Sep. 13, 1988

[54] TEMPORARY POWER LINE TOWER ASSEMBLY AND METHOD OF INSTALLING SAME

[75] Inventor: Keith E. Lindsey, La Canada, Calif.

[73] Assignee: Lindsey Manufacturing Company, Azusa, Calif.

[21] Appl. No.: 512,120

[22] Filed: Jul. 8, 1983

[51] Int. Cl.[4] ..... E04N 12/00; B66F 9/06

[52] U.S. Cl. ..... 52/40; 52/116; 248/184; 343/875

[58] Field of Search ..... 52/40, 111, 114, 116, 52/117, 646; 248/184; 343/874, 875, 886, 890, 891

[56] References Cited

U.S. PATENT DOCUMENTS

| | | | |
|---|---|---|---|
| 921,075 | 5/1909 | Brown | 52/40 X |
| 1,034,760 | 8/1912 | Bräckerbohm | 343/875 X |
| 1,664,922 | 4/1928 | Goodrich | 52/40 X |
| 2,403,080 | 7/1946 | Hilborn | 52/116 X |
| 2,510,059 | 6/1950 | Black | 52/40 |
| 3,527,435 | 9/1970 | Lapp et al. | 248/184 |

FOREIGN PATENT DOCUMENTS

| | | | |
|---|---|---|---|
| 197922 | 6/1967 | U.S.S.R. | 52/116 |

*Primary Examiner*—Carl D. Friedman
*Assistant Examiner*—Richard E. Chilcot, Jr.
*Attorney, Agent, or Firm*—Christie, Parker & Hale

[57] ABSTRACT

A temporary power line tower assembly and method of installing the same to serve emergency needs in restoring power service when a permanent tower is damaged or in need of repair. The temporary tower assembly includes a plurality of prefabricated sections the base section of which incorporates a gimbal joint and a rotary joint axially of the base section and normal to the gimbal axes at their point of intersection. The base section is provided with a lockout device operable to restrain all pivotal movement about the three pivot axes of the gimbal and the rotary joints to permit storage, transit and handling of the base section without risk of damage or injury to personnel.

32 Claims, 2 Drawing Sheets

TEMPORARY POWER LINE TOWER ASSEMBLY AND METHOD OF INSTALLING SAME

This invention relates to a demountable temporary power line tower assembly, and more particularly to a unique assembly having a gimbal section at its base end incorporating both a rotary and gimbal joints with their respective axes normal to one another and including lockout means for deactivating all pivotal movement when desired and to an improved method of erecting said temporary tower assembly.

BACKGROUND OF THE INVENTION

A variety of abnormal conditions, mishaps, accidents, etc., can cause disruption of high tension power lines by reason of damage or failure of one or more of the permanent towers. The ensuing interruption of power supply can have extremely serious consequences to both the public utility and its customers. For example, it is roughly estimated that the cost of service interruption on a main power line averages $500,000.00 per day. These interruptions and need for expedited service restoration operations are likely to occur in exceedingly rough and inaccessible terrain. In consequence, it may not be possible to utilize customary and requisite heavy duty equipment to erect conventional tower hardware. The attending problems are exacerbated by the need to provide temporary power line support structures displaced from the installed line to permit unobstructed access for repair of the damaged towers without risk of injury to life and property.

Emergency tower hardware has been proposed to provide temporary restoration of power service utilizing prefabricated units interconnectible at the site employing light duty installation equipment. Typically, assembled sections of such temporary towers are 100 or more feet in length and this poses problems and risks of serious injury while the tower is being uprighted onto its foundation. Proposals have been made for providing the lower end of the tower assembly with a fulcrum seatable in a concavity secured to the foundation. Such an arrangement is very hazardous for obvious reasons.

SUMMARY OF THE INVENTION

This invention overcomes the shortcomings and disadvantages characterising prior proposals for the construction and method of handling and erecting temporary power line towers. According to this invention, temporary power line towers are assembled from a plurality of prefabricated sections readily transported to the site by lightweight equipment or by air lift. Inspections for each tower include a base section incorporating a gimbal joint and a rotary joint having their axes intersecting at right angles. These joints are preferably located adjacent the lower end of the base or gimbal section. Risk of injury to property or to personnel is circumvented by lock out means readily manipulated to secure the opposite ends of the section against all movement in any direction during storage, transit or handling of the section. At the installation site the lockout is deactivated and the base end section is secured to the foundation. Thereafter, the upper end of the gimbal section is pivoted to and secured in an upright position by itself or while attached to one or more prefabricated tower sections. During erection, all components of the three jointed base section are securely assembled together but free to pivot relative to one another in a fully captive state.

Accordingly, it is a primary object of this invention to provide a unique temporary power line tower assembly and method of erecting the same which tower assembly includes a prefabricated base section incorporating a rotary and a gimbal joint having their axes intersecting at right angles to one another.

Another object of the invention is the provision of a base section for a temporary power line tower having a gimbal joint and a rotary joint with their intersecting axes at right angles to one another and including lockout means optionally usable to restrain all relative rotary movement about these three axes.

Another object of the invention is the provision of a gimbal tower section designed for installation between a tower foundation and one or more overlying tower sections and including simple and readily accessible means for holding the gimbal and rotary joints separably assembled.

These and other more specific objects will appear upon reading the following specification and claims and upon considering in connection on therewith the attached drawing to which they relate.

Referring now to the drawing in which a preferred embodiment of the invention is illustrated:

Figure 1:
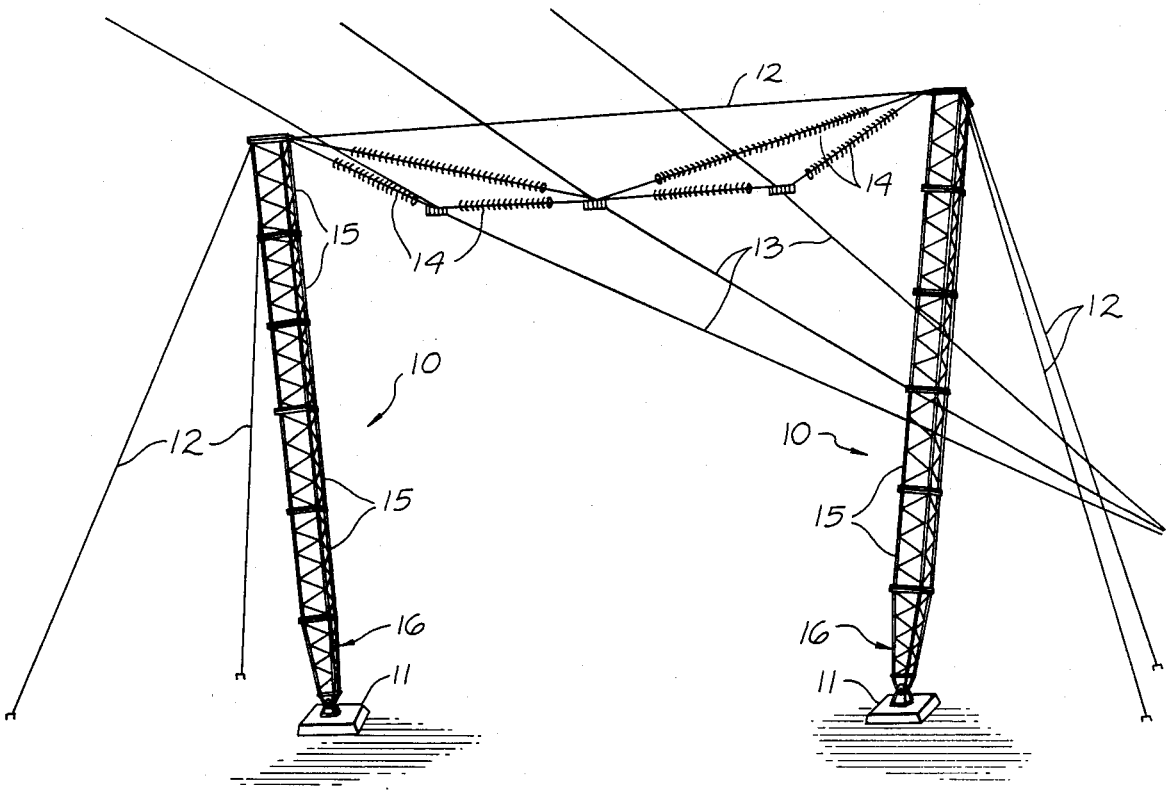
FIG. 1 is a view showing a pair of temporary power line supporting towers fully erected and supporting a three phase high tension power line.

Referring to FIG. 1, there is shown a pair of temporary towers, designated generally 10, having their lower ends anchored to foundation 11 and their upper ends held substantially immovable by guy lines 12. Three phase power line 13 is suitably supported between the tops of the towers by strings of insulators 14. Each tower assembly 10 comprises a plurality of prefabricated sections 15 rigidly secured together in end-to-end alignment in any suitable manner by bolts or other fasteners. Sections 15 are similar to one another but may differ in length where necessary to provide a tower assembly of a desired height.

Base or gimbal sections 16 are specially fabricated and designed to facilitate safe and expeditious erection of this section alone or secured to one or more sections 15 at the installation site.

Figure 2:
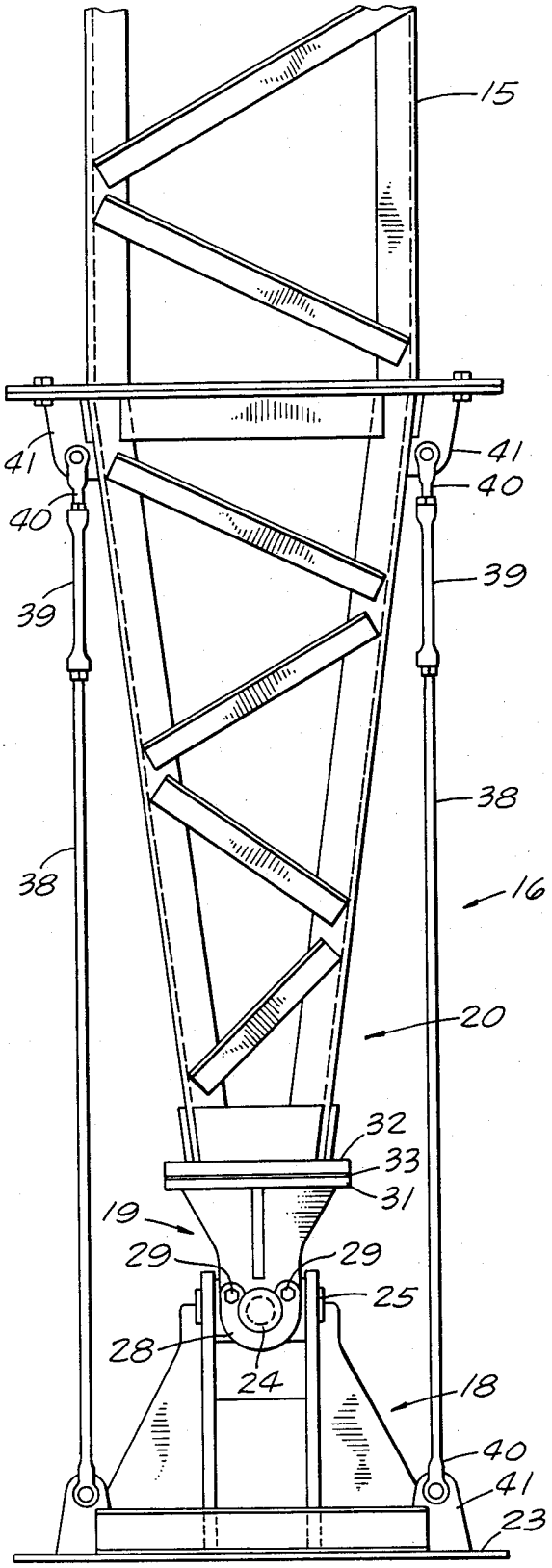
FIGS. 2 and 3 are elevational views of the base or gimbal section of the tower with the lockout device interconnecting the opposite ends thereof assembled to restrain all relative movements of the components about the three joint axes.
Figure 3:
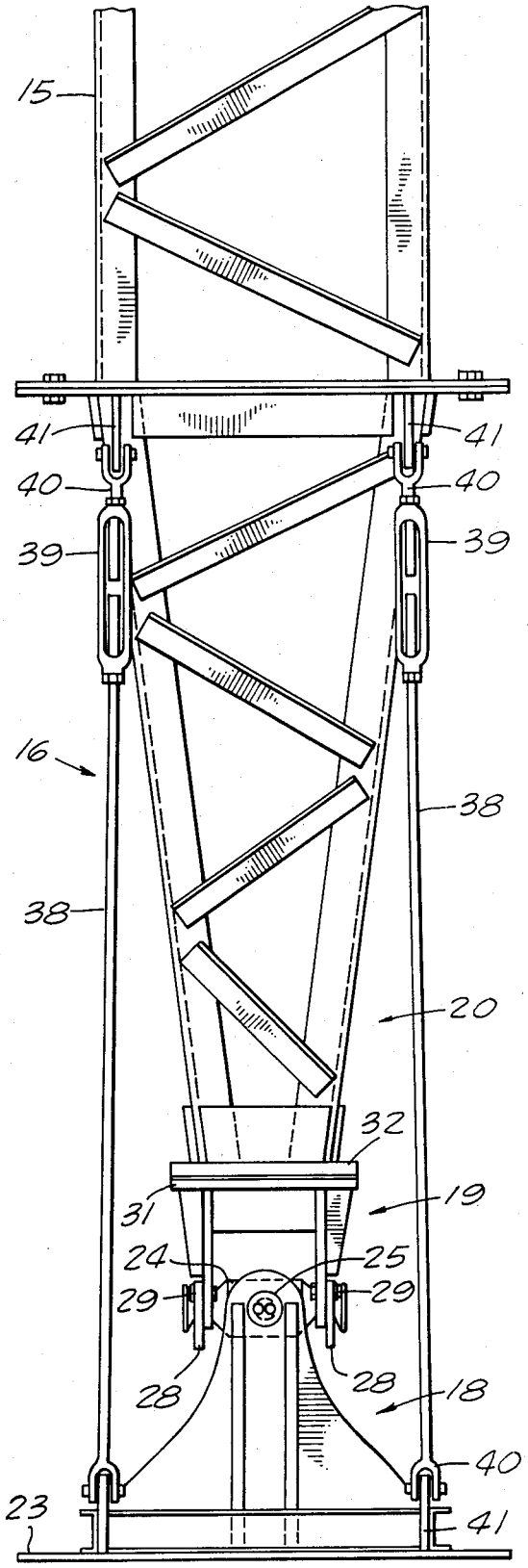

Typically, gimbal sections 16 are constructed as shown in FIGS. 2 and 3 wherein the opposite ends are rigidly interconnected by lockout means for purposes which will be described presently. The gimbal section 16 is preferably fabricated from lightweight high strength structural aluminum components welded together to form three subassemblies including a base subassembly 18, an intermediate subassembly 19 and an elongated conical subassembly 20. Base unit 18 includes a base plate 23 provided with holes, not shown, for anchoring the same to the foundation 11. Subassemblies 18 and 19 include U-shaped yokes having their legs overlapping but lying in planes at right angles to one another. The legs of these two yokes are interconnected by a pair of gimbal shafts 24, 25 joined to and criss crossing one another with their axes lying at right angles and in a common plane. The outer ends of shaft 24 are journalled in the legs of yoke 19 and the outer ends of shaft 25 are journalled in the legs of yoke 18. The two units 18 and 19, are held detachably assembled to one another by two U-shaped keeper rings 28—28 and two pairs of assembly bolts 29. Keeper rings 28 seat in respective annular grooves encircling the outer ends of gimbal shaft 24.

Figure 4:
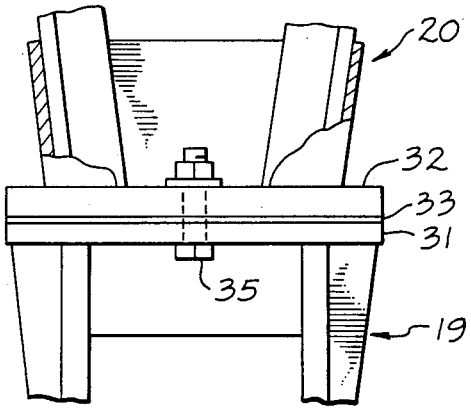
FIG. 4 is a fragmentary view on a slightly enlarged scale of the rotary joint with a portion of the forward wall of its housing broken away.

In addition to the gimbal joint, the gimbal section is provided with a rotary joint the details of which are best shown in FIG. 4. The upper end of yoke subassembly 19 includes a bearing plate 31. Likewise the lower end of the conical subassembly 20 includes a plate 32 parallel to plate 31 and separated therefrom by a plate of suitable bearing material 33. The components 31, 32, 33 are held journalled together for rotation about the axis of an interconnecting shaft provided by the shank of bolt 35. The axis of bolt 35 lies normal to and intersects the axes of gimbal shafts 24 and 25.

Restraining means for positively locking out relative movement of the opposite ends of gimbal section 16 is conveniently provided by four tie rods 38, each equipped with turn buckles 39 and clevises 40 bolted to tangs 41 welded or otherwise fixed to the opposite ends of section 16. Tie rods 38 are readily detached by loosening the turn buckles 39 and removing the bolts holding clevises 40 to tangs 41.

Prior to connection of subassembly 18 of the gimbal joint, tie rods 38 are preferably installed and tensioned to avoid risk of injury to property and personnel. The gimbal section may weigh several hundred pounds and is very dangerous unless the lockout tie rods or the like are present. However, after the gimbal section has been transported to the erection site, the tie rods are detached. Likewise and if preferred during airlift assembly operations, the keeper plates 28 are also detached to facilitate the handling of subassembly 18 while being secured to the foundation. Thereafter, shaft 24 is reseated and keepers 28 and the bolts 29 are reassembled to lock the gimbal positively in assembled condition and in readiness for further erection.

Erection of the temporary tower assembly 10 may be carried out in various ways depending on the equipment available, the size of the tower assembly and other working conditions. In some cases the gimbal section 16 is erected by pivotal movement about one of its shafts 24–25. If this section is uprighted by itself as a unit the crew may prefer to anchor it in an upright position by reinstalling the tie rods 38 if these have been detached. Thereafter, one or more upper sections 15 are installed atop the gimbal section using cranes or helicopters. One or several upper tower sections may be installed at the same time or individually, ample use being made of guy lines or cables 12. Once a tower assembly has been firmly secured in place, tie rods 38, if employed to stabilize the gimbal section, are detached and the tower assembly is free for very limited pivotal and rotary movement about one or more of its three axes. Alternatively, the tie rod 38 may be retained tightened and in place. As soon as one or more towers have been erected and guyed, strings of insulators and power line hardware are installed along with temporary power cables connected to the main power line.

While the particular temporary power line tower assembly and method of installing same herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That improvement in a power line tower assembly of the type having a plurality of factory-prefabricated sections designed for rigid end-to-end connection to one another at an installation site to provide a generally upright rigid tower assembly supported by a plurality of guy lines, said improvement comprising:

one or more tower sections;

a gimbal section for rigid attachment to the lower end of said toward sections, and said gimbal section including a prefabricated lower base subassembly and an upper subassembly pivotally interconnected by gimbal joint means having a pair of pivot axes at right angles to one another in a plane extending transversely of said gimbal section.

2. That improvement defined in claim 1 characterized in the provision of a rotary connection interconnecting said upper gimbal subassembly and the lowermost end of said tower section on an axis normal to the axes of said gimbal joint means.

3. That improvement defined in claim 2 characterized in the provision of means detachably securing said base and upper gimbal subassemblies together.

4. That improvement defined in claim 2 characterized in that said base and upper gimbal subassemblies are constructed and arranged for the pivotal movement of said upper subassembly in any radial plane containing the axis of said rotary connection.

5. That improvement defined in claim 1 characterized in the provision of lockout means operatively interconnecting said base subassembly and said upper subassembly and effective to prevent all relative movement between said base and upper subassemblies of said gimbal section during the storage, shipment and handling thereof or during the erection of said gimbal section by itself or while installing other tower sections to the top of an installed gimbal section.

6. That improvement defined in claim 5 characterized in that said lockout means comprises a plurality of adjustable tie means interconnecting remotely spaced end portions of said base and upper subassemblies of said gimbal section.

7. That improvement in a temporary power line tower assembly having a plurality of factory prefabricated sections adapted to be rigidly interconnected in end-to-end relation at the field erection site which improvement comprises:

said prefabricated sections including a prefabricated gimbal section having a base subassembly designed for rigid securement to a foundation and an upper subassembly jounralled thereto on a pair of axes at right angles to one another and lying in a transverse plane through said gimbal section; and a plurality of said sections being adapted to be rigidly connected together in end-to-end series relation and tilted as a unitary assembly about one of said gimbal axes from a generally horizontal position to an upright operating position and stabilized therein by a plurality of guy lines.

8. That improvement defined in claim 7 characterized in the provision of adjustable means for interconnecting said base and upper subassemblies in a manner locking out relative pivotable movement between said gimbal section and the remainder of said sections.

9. That improvement defined in claim 7 characterized in the provision of means for holding said base and upper subassemblies of said gimbal section rigidly interconnected during storage and handling to avoid the risk of injury to property and personnel.

10. That improvement defined in claim 7 characterized in that said gimbal section is fabricated principally of structural light weight metal elements welded together.

11. That improvement defined in claim 7 characterized in the provision of rotary pivot means intermediate the opposite ends of one of said base and upper subassemblies of said gimbal section which rotary pivot means has an axis normal to and intersecting said pair of gimbal axes.

12. That method of erecting a temporary power line support tower while a permanent tower is undergoing servicing which method comprises:

installing a foundation adjacent a permanent tower in need of servicing;

providing a temporary substitute tower assembly including a gimbal tower section having a pair of journals extending crosswise thereof on axes at right angles to one another; and providing means operable to prevent pivotal movement about the axis of either of said journals while said gimbal tower section is in storage or in transit to said installation foundation therefor.

13. That method defined in claim 12 characterized in the steps of anchoring one end of said gimbal tower section to said foundation while the opposite ends thereof are free to pivot about one of said pair of journals; and thereafter pivoting the other end of said gimbal tower section into a generally upright position.

14. That method defined in claim 13 characterized in the steps of securing at least one prefabricated tower section to the end of said gimbal tower section remote from said foundation before pivoting the assembled gimbal and tower sections to a generally upright position.

15. That method defined in claim 14 characterized in the step of positively restraining relative pivot movement of the opposite ends of said gimbal tower section about the axis of either of said pair of journals preparatory to securing an additional one or more aligned tower sections to the top of said gimbal tower section.

16. That method defined in claim 15 characterized in the steps of attaching anchored guy lines about said interconnected tower sections, and releasing said gimbal tower section from restraint for limited movement about the axes of said gimbal journals.

17. That improvement in a temporary power line tower assembly which comprises:

a plurality of prefabricated tower sections rigidly securable to one another in end-to-end relation;

a prefabricated gimbal tower section adapted to be assembled between a tower foundation and the lowermost end of the adjacent one of said tower sections;

said gimbal tower section having:

(a) a base securable to said tower foundation and including gimbal joint means provided with pivot axes at right angles to one another and lying in a plane extending transversely of said gimbal tower section and further including rotary joint means having an axis normal to and intersecting the junction of the axes of said gimbal joint means, and (b) a generally frusto-conical tower structure having its smaller end rigidly connected to at least one end of said gimbal joint means and said rotary joint means.

18. That improvement defined in claim 17 characterized in the provision of lockout means for interconnecting the opposite ends of said gimbal tower section and operable to lock out substantially all relative movement between the opposite ends of said gimbal tower section.

19. That improvement defined in claim 17 characterized in the provision of means holding at least one of said rotary joint means and said gimbal joint means separably assembled.

20. Thal improvement defined in claim 17 characterized in the provision of means holding each of said rotary joint means and said gimbal joint means separably and selectively assembled.

21. That method of expediting the erection of a temporary power line support tower for a power line while a disabled permanent tower of said power line is undergoing servicing which method comprises:

preparing a foundation adjacent said disabled tower;

providing a temporary tower comprising a plurality of prefabricated long sections adapted to be secured together in end-to-end relation at the site of the servicing operation for upright erection on said foundation including a lowermost section equipped at the lower end thereof with a gimbal having journals extending transversely thereof on axes at right angles to one another; and providing said lowermost section with means for deactivating pivotal movement of said gimbal about the axes thereof while said lowermost section is in storage or in transit to said foundation.

22. That method defined in claim 21 characterized in the step of rigidly coupling a plurality of said prefabricated tower sections together in end-to-end relation with said gimbal closely adjacent said foundation.

23. That method defined in claim 22 characterized in the steps of uprighting said rigidly coupling tower sections; securing the lower end of said gimbal to said foundation; and holding said temporary tower in a desired upright position by a plurality of anchored guy lines.

24. That method defined in claim 22 characterized in the steps of rigidly coupling a plurality of said prefabricated tower sections together in end-to-end relation, reactivating the pivoting capability of said gimbal about at least one of said axes at right angles to one another; securing the lowermost portion of said gimbal to said foundation with said one pivot axis thereof lying horizontal; tilting said temporary tower into a generally upright position about said one pivot axes; and securing said temporary tower in said upright position by a plurality of anchored guy lines.

25. That method defined in claim 21 characterized in the steps of positively deactivating the pivoting capability of said gimbal about either of said axes thereof; upending said lowermost tower section onto said foundation; and anchoring said lowermost section in said upright position.

26. That method defined in claim 25 characterized in the steps of lifting one or more of said tower sections into an upright position in series alignment with said lowermost section; securing said sections rigidly together; and holding said assembled tower sections in said aligned position by anchored guy lines.

27. That method of expediting the erection of a pair of temporary supports for a power line while a disabled permanent power line support means is undergoing repair which method comprises:

installing separate foundations offset laterally from one another transversely of said power line;

providing a plurality of separate temporary tower sets each set comprising a plurality of prefabricated long sections adapted to be transported as separate units to the temporary erection site and each set of sections adapted to be secured together in end-to-end relation including a lowermost section equipped at the lower end thereof with a gimbal having journals extending transversely thereof on axes at right angles to one another; and each of said lowermost sections having means for deactivating the associated one of said gimbals from pivotal movement about either of said axes prior to need for the functioning of said gimbals.

28. That method defined in claim 27 characterized in the steps of separately assembling said sets of temporary tower sections in rigidly connected series with one another with the gimbals thereof positioned closely adjacent a respective one of said foundations; tilting each of said assembled temporary towers to a generally upright position followed by the securement of the gimbal thereof to a respective one of said foundations; and utilizing guy lines to anchor said temporary towers to one another and to the ground thereabout.

29. That method defined in claim 27 characterized in the step of deactivating said means for holding said gimbals against pivotal movement after said lowermost tower sections have been transported to the site of the disabled permanent tower in need of repairs.

30. That improvement in a supported tower for a power line which comprises:

a heavy duty gimbal assembly adapted to be assembled to the lower end of a power line tower at an installation site along a power line;

said gimbal assembly including a first subassembly securable to a tower foundation and a second subassembly adapted to be connected to the lower end of a powerline tower;

journal means for holding said first and second subassemblies positively assembled for pivotal movement about a pair of axes at right angles to one another through an arc including a vertical plane and a generally horizontal plane; and means interconnecting said first and second subassemblies for locking said subassemblies against relative pivot movement while being handled and/or transported from a fabrication site to an installation site.

31. That improvement defined in claim 30 characterized in that one of said first and second subassemblies includes journal means having an axis normal to said gimbal axes and intersecting the junction of said gimbal axes.

32. That improvement defined in claim 30 characterized in that means for locking said first and second gimbal subassemblies against relation pivotal movement are detachable at an installation site whereby one or more tower sections may be interconnected to one another and to said second gimbal subassembly so that the assembled components of said tower are being tilted from a generally horizontal position to a generally upright operating position.

* * * * *